US011230984B2

(12) United States Patent
Hashimoto et al.

(10) Patent No.: US 11,230,984 B2
(45) Date of Patent: Jan. 25, 2022

(54) CONTROLLER AND CONTROL METHOD FOR INTERNAL COMBUSTION ENGINE

(71) Applicant: TOYOTA JIDOSHA KABUSHIKI KAISHA, Toyota (JP)

(72) Inventors: Yosuke Hashimoto, Nagakute (JP); Akihiro Katayama, Toyota (JP); Yuta Oshiro, Nagoya (JP); Kazuki Sugie, Toyota (JP); Naoya Oka, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/163,784

(22) Filed: Feb. 1, 2021

(65) Prior Publication Data

US 2021/0239060 A1 Aug. 5, 2021

(30) Foreign Application Priority Data

Feb. 5, 2020 (JP) ..... JP2020-017815

(51) Int. Cl.
*F02D 41/14* (2006.01)
*F02D 41/24* (2006.01)

(52) U.S. Cl.
CPC ..... *F02D 41/1402* (2013.01); *F02D 41/2422* (2013.01); *F02D 41/2441* (2013.01); *F02D 2041/1431* (2013.01); *F02D 2200/602* (2013.01)

(58) Field of Classification Search
CPC ..... F02D 41/1402; F02D 41/2422; F02D 41/2441; F02D 2041/1431; F02D 2200/602; F02D 41/2429
See application file for complete search history.

(56) References Cited

U.S. PATENT DOCUMENTS 6,032,139 A 2/2000 Yamaguchi
6,064,996 A 5/2000 Yamaguchi
(Continued)

FOREIGN PATENT DOCUMENTS

JP 2016-6327 A 1/2016
WO WO-2020216471 A1 * 10/2020 ..... F02D 41/1406

OTHER PUBLICATIONS

Lin Xue et al., "Reinforcement Learning Based Power Management for Hybrid Electric Vehicles", 2014 IEEE/ACM International Conference On Computer-Aided Design (ICCAD), IEEE, Nov. 2, 2014, pp. 32-38 (Year: 2014).
(Continued)

*Primary Examiner* — Sizo B Vilakazi
*Assistant Examiner* — Mark L. Greene
(74) *Attorney, Agent, or Firm* — Oblon, McClelland, Maier & Neustadt, L.L.P.

(57) ABSTRACT

A controller includes a memory device and an execution device that executes first and second operation processes, a switching process, and a recording process. The first operation process operates an operated unit by an operated amount, which is calculated on the basis of a state variable, using an adapted data set. The second operation process operates the operated unit by an operated amount that is defined by a relationship defining data set and the state variable. The switching process switches a process that operates the operated unit between the first operation process and the second operation process. The recording process obtains a value of the state variable used in calculation of the operated amount using the first operation process during an operation of the operated unit using the second operation process. The recording process also records time-series data of the obtained value of the state variable in the memory device.

6 Claims, 6 Drawing Sheets

(56) References Cited

U.S. PATENT DOCUMENTS

| | | | | |
|---|---|---|---|---|
| 6,425,374 | B1 | 7/2002 | Schmitz | |
| 6,549,815 | B1 | 4/2003 | Kaji | |
| 2004/0078095 | A1 | 4/2004 | Mizutani | |
| 2012/0117011 | A1 | 5/2012 | Hashimoto | |
| 2017/0234251 | A1 | 8/2017 | Commenda | |
| 2018/0293814 | A1 | 10/2018 | Gilbert | |
| 2019/0242319 | A1 | 8/2019 | Matsumoto | |
| 2019/0329772 | A1 | 10/2019 | Graves | |
| 2020/0063676 | A1 | 2/2020 | Neema | |
| 2020/0063681 | A1 | 2/2020 | Neema | |
| 2020/0164745 | A1 | 5/2020 | Mohan | |
| 2020/0398859 | A1 | 12/2020 | Borhan | |
| 2021/0115834 | A1 | 4/2021 | Hashimoto | |
| 2021/0115866 | A1 | 4/2021 | Hashimoto | |
| 2021/0189990 | A1 | 6/2021 | Hashimoto | |
| 2021/0222640 | A1* | 7/2021 | Hashimoto | ..... F02D 41/10 |
| 2021/0231070 | A1* | 7/2021 | Hashimoto | ..... F02D 41/0002 |

OTHER PUBLICATIONS

Hu Yue et al., "Energy Management Strategy for a Hybrid Electric Vehicle Based on Deep Reinforcement Learning", Applied Sciences, vol. 8, No. 2, Jan. 26, 2018, pp. 1-15 (Year: 2018).

Hu Xiasong et al., "Reinforcement Learning for Hybrid and Plug-In Hybrid Electric Vehicle Energy Management: Recent Advances and Prospects", IEEE Industrial Electronics Magazine, IEEE, U.S., vol. 13, No. 3, Sep. 24, 2019, pp. 16-25 (Year: 2019).

Office Action dated Jul. 20, 2021 in related U.S. Appl. No. 17/151,721, filed Jan. 10, 2021.

Notice of Allowance dated Nov. 1, 2021 in related U.S. Appl. No. 17/151,721.

* cited by examiner

Fig.9A
Fig.9B
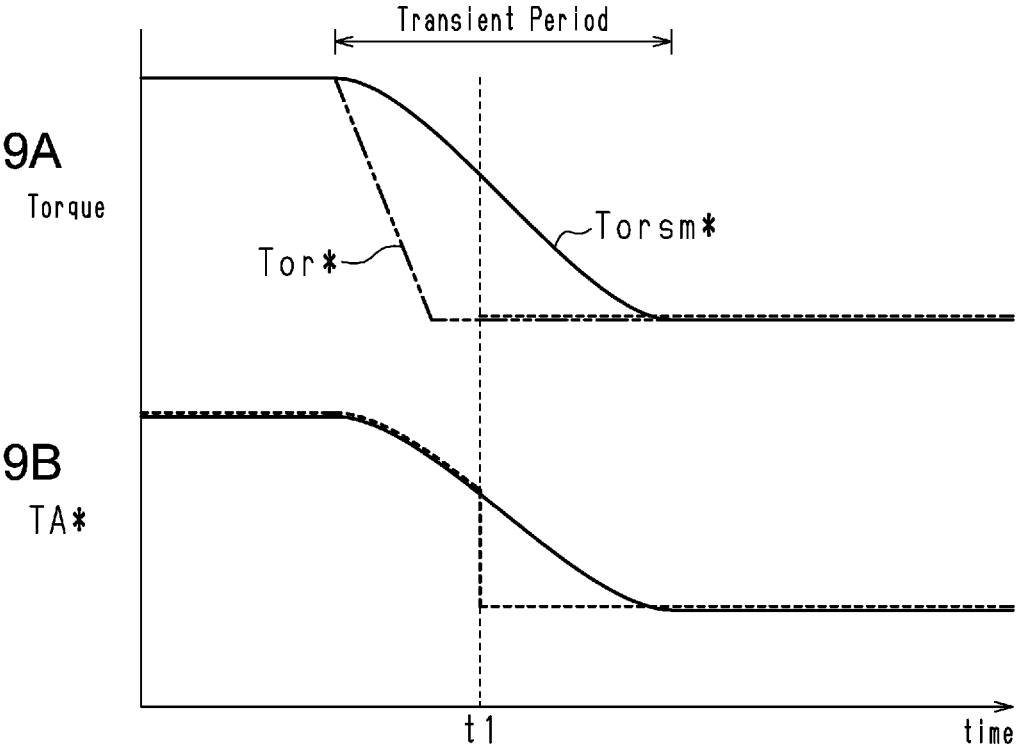
Fig.10
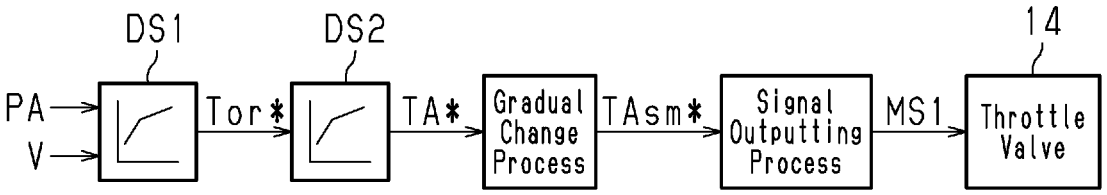

CONTROLLER AND CONTROL METHOD FOR INTERNAL COMBUSTION ENGINE

BACKGROUND

1. Field

The present disclosure relates to a controller and a control method for an internal combustion engine mounted on a vehicle.

2. Description of Related Art

Japanese Laid-Open Patent Publication No. 2016-006327 discloses a controller that operates a throttle valve, which is an operated unit of an internal combustion engine mounted on a vehicle, on the basis of a value obtained by subjecting an operated amount (e.g. depression amount) of an accelerator pedal to a process using a filter.

The above-described filter is required to set the operated amount of the throttle valve to a value that simultaneously satisfies demands for multiple factors such as the efficiency and exhaust characteristics of an internal combustion engine, and occupant comfort. Thus, adaptation of the filter requires a high number of man-hours of skilled workers. This also applies to adaptation of operated amounts of operated units of the engine other than the throttle valve.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, a controller for an internal combustion engine mounted on a vehicle is provided. The controller is configured to control the internal combustion engine by operating an operated unit of the internal combustion engine. The controller includes a memory device and an execution device. The memory device is configured to store, in advance a relationship defining data set and an adapted data set. The relationship defining data set defines a relationship between a state variable that represents a state of the vehicle, which includes a state of the internal combustion engine, and an operated amount of the operated unit. The relationship defining data set is updated during traveling of the vehicle. The adapted data set is used to calculate the operated amount based on the state variable. The adapted data set is not updated during traveling of the vehicle. The execution device is configured to execute an operation of the operated unit. The execution device is configured to execute: a first operation process that operates the operated unit by the operated amount, which is calculated on a basis of the state variable, using the adapted data set; a second operation process that operates the operated unit by the operated amount that is defined by the relationship defining data set and the state variable; a reinforcement learning process that calculates a reward on a basis of the state variable when the operated unit is being operated using the second operation process, and updates the relationship defining data set so as to increase an expected return of the reward on a basis of the state variable, the operated amount, and the reward; a switching process that switches a process that operates the operated unit in accordance with the state of the vehicle between the first operation process and the second operation process; and a recording process that obtains a value of the state variable used in the calculation of the operated amount using the first operation process during the operation of the operated unit using the second operation process, and records time-series data of the obtained value of the state variable to the memory device.

In the above-described controller for an internal combustion engine, the first operation process executes calculation of the operated amount using the adapted data, which is stored in the memory device in advance. During operation of the operated unit of the internal combustion engine using the first operation process, the operated amount must be adapted before shipping of the vehicle. In contrast, during execution of the second operation process, the reward is calculated on the basis of the state of the vehicle, which changes as the result of operating the operated unit using the second operation process. The relationship defining data set is updated such that the expected return of the reward is increased. That is, during the operation of the operated unit of the internal combustion engine using the second operation process, adaptation of the operated amount through the reinforcement learning is advanced. The operated amount when the operated unit is operated using the second operation process can be automatically adapted during traveling of the vehicle. This reduces the number of man-hours of skilled workers required to adapt the operated amount. However, the reinforcement learning must be performed under various conditions of the vehicle while taking relatively long amounts of time. Thus, depending on the operation of the vehicle, it takes a considerable amount of time to complete the adaptation. Therefore, depending on the operating state of the vehicle, more desirable outcomes may be produced by completing the adaptation of the operated amount before the shipment of the vehicle than by adapting the operated amount through reinforcement learning during traveling of the vehicle. In this regard, the execution device in the above-described controller for an internal combustion engine switches, in the switching process, the process of operating the operated unit in accordance with the state of the vehicle between the first operation process and the second operation process. Therefore, the above-described controller for an internal combustion engine readily reduces the number of man-hours of skilled workers required to adapt the operated amount of the operated unit of the internal combustion engine.

In some cases, the values used to calculate the operated amount in the first operation process include a value that is updated in accordance with an update amount calculated from the value of the state variable at each calculation of the operated amount. The update of the value in this case is performed on the basis of an instantaneous value of the state variable at the time. The updated value is a value that is obtained by integrating the update amount calculated on the basis of the value of the state variable of each calculation of the operated amount up to that moment. In this manner, even in a case in which the calculation of the operated amount in the first operation process is performed on the basis of the instantaneous value of the state variable, the operated amount may be calculated as a value that reflects changes in the state variable up to that moment. In such a case, the calculated value of the operated amount immediately after switching from the second operation process to the first operation process does not reflect the changes in the state variable during the second operation process. Thus, the operated amount is set to a value different from that in a case in which the first operation process has been continued.

In this regard, the execution device in the above-described controller for an internal combustion engine obtains, in the recording process, the value of the state variable used in the calculation of the operated amount using the first operation process during the operation of the operated unit using the second operation process. The execution device also records the time-series data of the obtained value of the state variable to the memory device. When the process that operates the operated unit is switched from the second operation process to the first operation process, referring to the recorded time-series data allows the operated amount to be set to a value that reflects changes in the value of the state variable during the execution of the second operation process prior to the switching.

In the recording process, the larger the number of state variables of which the time-series data is recorded, the larger the quantity of memory in the memory device used to record the data becomes. When the operated amount is calculated using the first operation process, state variables that preferably reflect changes in the previous values are only part of one or more variables used in the calculation of the operated amount. Therefore, in such a case, the state variables of which the time-series data is recorded to the memory device in the recording process may be part of the one or more state variables used in the calculation of the operated amount using the first operation process. The state variables of which the time-series data is preferably recorded include the ones listed below.

In some cases, a specific state variable is used as a variable that is controlled (controlled variable), and the first operation process includes a feedback correction process that corrects the operated amount in accordance with the difference between the target value and the detected value of the controlled variable. It takes a certain amount of time for the feedback correction process to cause the controlled variable to converge to the target value. Thus, when the feedback correction process is started at the same time as when the second operation process is switched to the first operation process, the controlled variable temporarily deviates from the target value. The controllability of the internal combustion engine thus may deteriorate. In this regard, if the time-series data of the state variable that is used as the controlled variable of the feedback correction process is recorded in the recording process, the operated amount of which the target value is the controlled variable can be obtained by referring to the time-series data. This reduces deterioration of the controllability of the internal combustion engine immediately after the second operation process is switched to the first operation process.

Also, when the first operation process includes a gradual change process discussed below, time-series data of a state variable shown below, which is used in the calculation of the operated amount using the gradual change process, may be recorded using the recording process. The calculation of the operated amount using the gradual change process uses a data set included in the adapted data set defining a map that uses a specific state variable as an input and outputs an operated amount. The gradual change process is one of the following processes: a process that uses a detected value of a state variable as an input, and outputs, as an input value to the map, a value that changes after a delay in relation to the detected value, or a process that uses an output value of the map as an input, and outputs a value that changes after a delay in relation to the output value as a calculated value of an operated amount. The gradual change process is executed to calculate the operated amount as a value that changes after a delay from a change in the state variable. That is, the operated amount that is calculated using the gradual change process is calculated as a value that reflects changes in the state variable in the past. Therefore, the time-series data of the state variable is preferably recorded using the recording process.

Some vehicles perform a manual acceleration travel, in which the vehicle is accelerated or decelerated in response to an operation of an accelerator pedal by a driver, and an automatic acceleration travel, in which the vehicle is automatically accelerated or decelerated regardless of the operation of the accelerator pedal. In such a vehicle, the operation of the internal combustion engine can vary significantly between the automatic acceleration travel and the manual acceleration travel. As a result, to produce a desirable outcome, the automatic acceleration travel and the manual acceleration travel may have to use a different one of the two adaptation methods, which are the adaption through reinforcement learning during traveling of the vehicle and the adaption through a conventional method prior to shipping of the vehicle. Accordingly, when the internal combustion engine of this type of vehicle is equipped with the above-described controller, the switching process may switch the process of operating the operated unit between the first operation process and the second operation process depending on whether the vehicle is performing the manual acceleration travel or the automatic acceleration travel.

In another general aspect, a method of controlling an internal combustion engine mounted on a vehicle by operating an operated unit of the internal combustion engine is provided. The method includes: storing, in advance, a relationship defining data set that defines a relationship between a state variable that represents a state of the vehicle, which includes a state of the internal combustion engine, and an operated amount of the operated unit, the relationship defining data set being updated during traveling of the vehicle; storing, in advance, an adapted data set that is used to calculate the operated amount based on the state variable, the adapted data set not being updated during traveling of the vehicle; and executing an operation of the operated unit. The executing the operation of the operated unit includes executing: a first operation process that operates the operated unit by the operated amount, which is calculated on a basis of the state variable, using the adapted data set; a second operation process that operates the operated unit by the operated amount that is defined by the relationship defining data set and the state variable; a reinforcement learning process that calculates a reward on a basis of the state variable when the operated unit is being operated using the second operation process, and updates the relationship defining data set so as to increase an expected return of the reward on a basis of the state variable, the operated amount, and the reward; a switching process that switches a process that operates the operated unit in accordance with the state of the vehicle between the first operation process and the second operation process; and a recording process that obtains a value of the state variable used in calculation of the operated amount using the first operation process during an operation of the operated unit using the second operation process, and records time-series data of the obtained value of the state variable.

Other features and aspects will be apparent from the following detailed description, the drawings, and the claims.

BRIEF DESCRIPTION OF THE DRAWINGS

FIG. 9A is a timing diagram showing changes in a requested torque Tor* and a requested torque gradual change value Torsm*.

FIG. 9B is a timing diagram showing changes in an opening degree command value TA*.

FIG. 10 is a block diagram showing flows of processes related to operation of a throttle valve in a first operation process according to a modification.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A controller 70 for an internal combustion engine 10 according to an embodiment will now be described with reference to FIGS. 1 to 9B.

Figure 1:
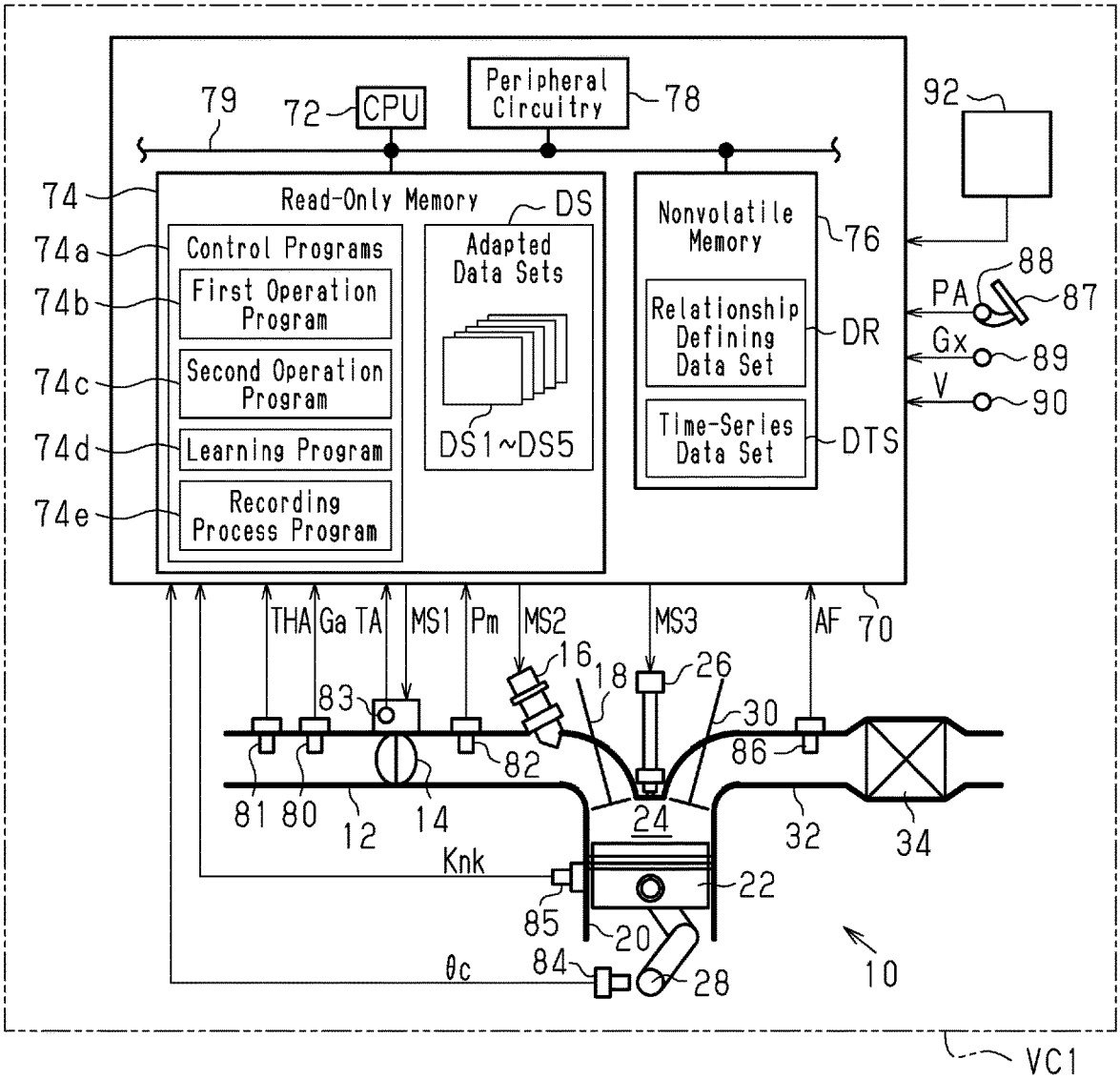
FIG. 1 is a schematic diagram showing a controller for an internal combustion engine according to an embodiment.

FIG. 1 shows the configuration of the controller 70 of the present embodiment and the internal combustion engine 10 mounted on a vehicle VC1. The controller 70 controls the internal combustion engine 10. The internal combustion engine 10 includes an intake passage 12, in which a throttle valve 14 and a fuel injection valve 16 are arranged in that order from the upstream side. Air drawn into the intake passage 12 and fuel injected from the fuel injection valve 16 flow into a combustion chamber 24, which is defined by a cylinder 20 and a piston 22, when an intake valve 18 is opened. The air-fuel mixture is burned by spark discharge of an ignition device 26 in the combustion chamber 24, and the energy generated by the combustion is converted into rotational energy of a crankshaft 28 via the piston 22. The burned air-fuel mixture is discharged to an exhaust passage 32 as exhaust gas when an exhaust valve 30 is opened. The exhaust passage 32 incorporates a catalyst 34, which is an aftertreatment device for purifying exhaust gas.

The controller 70 operates operated units of the internal combustion engine 10 such as the throttle valve 14, the fuel injection valve 16, and the ignition device 26, thereby controlling parameters such as the torque and the ratios of exhaust components, which are controlled variables indicating the state of the internal combustion engine 10. FIG. 1 shows operation signals MS1 to MS3 respectively corresponding to the throttle valve 14, the fuel injection valve 16, and the ignition device 26.

The controller 70 obtains detected values of various sensors that detect the state of the internal combustion engine 10 in order to control the controlled variables of the internal combustion engine 10. The sensors that detect the state of the internal combustion engine 10 include an air flow meter 80, which detects an intake air amount Ga, an intake air temperature sensor 81, which detects an intake air temperature THA, an intake pressure sensor 82, which detects an intake pressure Pm, a throttle sensor 83, which detects a throttle opening degree TA of the throttle valve 14, and a crank angle sensor 84, which detects a rotational angle θc of a crankshaft 28. The sensors also include a knock sensor 85, which outputs a knock signal Knk indicating the occurrence of knocking in the combustion chamber 24, and an air-fuel ratio sensor 86, which detects an air-fuel ratio AF of the air-fuel mixture that has been burned in the combustion chamber 24. The controller 70 also refers to detected values of sensors that detect the state of the vehicle VC1, such as an accelerator pedal sensor 88, which detects an accelerator operated amount PA (the amount of depression of an accelerator pedal 87), an acceleration sensor 89, which detects an acceleration Gx in the front-rear direction of the vehicle VC1, and a vehicle speed sensor 90, which detects a vehicle speed V.

Further, the vehicle VC1 includes an operation panel 92, which switches the traveling mode between a manual acceleration travel and an automatic acceleration travel and/or changes a target speed of the automatic acceleration travel. The manual acceleration travel is a traveling mode in which the vehicle VC1 is accelerated or decelerated in response to operation of the accelerator pedal 87 by the driver. The automatic acceleration travel is a traveling mode that is not based on the operation of the accelerator pedal 87. That is, in the automatic acceleration travel, the vehicle VC1 is automatically accelerated or decelerated so that the vehicle speed V is maintained at the target speed regardless of the operation of the accelerator pedal 87. When controlling the controlled variables of the internal combustion engine 10, the controller 70 refers to the value of a mode variable MV, which indicates which of the manual acceleration travel and the automatic acceleration travel is being selected as the traveling mode of the vehicle VC1.

Switching from the manual acceleration travel to the automatic acceleration travel is permitted when a target speed is set, and a starting operation for cruise control is performed on the operation panel 92 in a state where predetermined cruise control permitting conditions are satisfied. The cruise control permitting conditions include a condition where the vehicle VC1 is traveling on a limited-access road, and a condition where the vehicle speed V is in a predetermined range.

Switching from the automatic acceleration travel to the manual acceleration travel is executed when the driver presses the brake pedal and/or performs a cruise control canceling operation on the operation panel 92.

The controller 70 includes a CPU 72 and peripheral circuitry 78. The CPU 72 is an execution device that executes processes related to control of the internal combustion engine 10. The peripheral circuitry 78 includes a circuit that generates a clock signal regulating internal operations, a power supply circuit, and a reset circuit. The controller 70 includes, as memory devices, a read-only memory 74, in which stored data cannot be rewritten during traveling of the vehicle VC1, and a nonvolatile memory 76, in which stored data can be electrically rewritten during traveling of the vehicle VC1. The CPU 72, the read-only memory 74, the nonvolatile memory 76, and the peripheral circuitry 78 are allowed to communicate with one another through a local network 79.

The read-only memory 74 stores control programs 74*a* for controlling the internal combustion engine 10. The control programs 74*a* include two programs: a first operation program 74*b* and a second operation program 74*c*, which are used to operate operated units of the internal combustion engine 10. The read-only memory 74 stores multiple adapted data sets DS, which are used in operations of the operated units of the internal combustion engine 10 with the first operation program 74*b*. The nonvolatile memory 76 stores a relationship defining data set DR, which defines the relationship between operated amounts and state variables representing the state of the vehicle VC1 including the state of the internal combustion engine 10. The relationship defining data set DR is used in operations of the operated units of the internal combustion engine 10 with the second operation program 74*c*. The read-only memory 74 stores a learning program 74*d*, which is a reinforcement learning process program for updating the relationship defining data set DR. The read-only memory 74 stores a recording process program 74*e*. The recording process program 74*e* is executed to record a time-series data set DTS of state variables in the nonvolatile memory 76.

The adapted data sets DS include various types of mapping data used in calculation of the operated amounts of the operated units of the internal combustion engine 10. The mapping data includes combinations of discrete values of input variables and values of output variables each corresponding to a value of the input variables. The mapping data includes a mapping data set DS1 for calculating requested torque, a mapping data set DS2 for calculating an opening degree, a mapping data set DS3 for calculating basic injection timing, and a mapping data set DS4 for calculating retardation limit ignition timing. The mapping data set DS1 for calculating a requested torque uses the accelerator operated amount PA and the vehicle speed V as input variables, and outputs an output variable that is a requested torque Tor*, which is a requested value of the torque of the internal combustion engine 10. The mapping data set DS2 for calculating an opening degree uses the torque of the internal combustion engine 10 as an input variable, and outputs an output variable that is a value of the throttle opening degree TA required to generate the torque. The mapping data set DS3 for calculating basic injection timing uses an engine rotation speed NE and an intake air amount KL as input variables, and outputs an output variable that is a basic ignition timing Abse. The basic ignition timing Abse is the more retarded one of the optimum ignition timing, which is an ignition timing at which the torque of the internal combustion engine 10 is maximized, and a trace-knock ignition timing, which is the advancement limit of the ignition timing that can suppress knocking. The mapping data set DS4 for calculating retardation limit ignition timing uses the engine rotation speed NE and the intake air amount KL as input variables, and outputs an output variable that is retardation limit ignition timing Akmf. The retardation limit ignition timing Akmf is a retardation limit of the range of the ignition timing in which combustion of air-fuel mixture in the combustion chamber 24 does not deteriorate.

The adapted data sets DS include a model data set DS5 for calculating an intake air amount. The model data set DS5 is the data of a physical model of the behavior of the intake air of the internal combustion engine 10, which is used to calculate the intake air amount KL flowing into the combustion chamber 24. The model data set DS5 is configured to output the intake air amount KL in accordance with input parameters such as the intake air amount Ga, the intake air temperature THA, the intake pressure Pm, the throttle opening degree TA, and the engine rotation speed NE.

The mapping data sets DS1 to DS4 and the model data set DS5 are adapted in advance such that operated amounts that are calculated using these data sets satisfy requirements such as the exhaust characteristics of the internal combustion engine 10, the fuel consumption rate, and the driver comfort. The mapping data sets DS1 to DS4 and the model data set DS5 are written in the read-only memory 74 prior to shipping of the vehicle VC1, and can be updated only by using dedicated equipment installed in maintenance facility. That is, the adapted data sets DS are not updated during traveling of the vehicle VC1.

Figure 2:
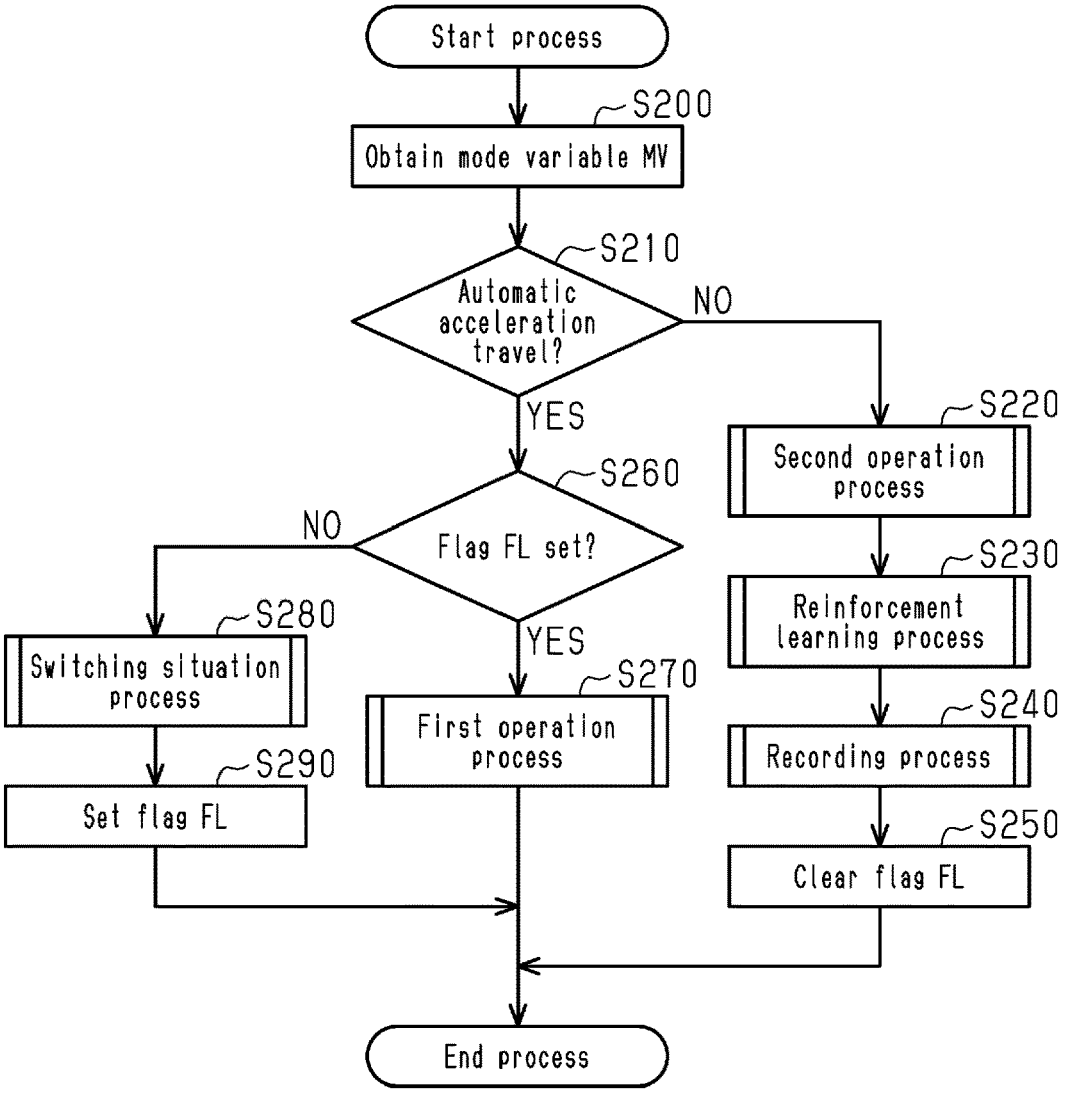
FIG. 2 is a flowchart showing a process executed by an execution device of the controller.

FIG. 2 shows the procedure of processes related to operations of operated units of the internal combustion engine 10 executed by the controller 70 according to the present embodiment. The processes shown in FIG. 2 are implemented by the CPU 72 repeatedly executing the control programs 74*a* stored in the read-only memory 74 at predetermined control cycles. In the following description, the number of each step is represented by the letter S followed by a numeral. In the present embodiment, depending on whether the vehicle VC1 is performing the manual acceleration travel or the automatic acceleration travel, a switching process is executed using the process of FIG. 2 in order to switch between operations of the operated units using a first operation process or operations of the operated units using a second operation process.

When the series of processes shown in FIG. 2 is started, the CPU 72 first obtains the value of the mode variable MV in step S200. Subsequently, the CPU 72 determines whether the traveling mode of the vehicle VC1, which is indicated by the value of the mode variable MV, is the automatic acceleration travel in step S210.

When the traveling mode of the vehicle VC1 at this time is not the automatic acceleration travel (S210: NO), that is, when the traveling mode is the manual acceleration travel, the CPU 72 executes, in step S220, the second operation process, which operates the operated units of the internal combustion engine 10 through execution of the second operation program 74*c*. Also, in the subsequent step S230, the CPU 72 executes the reinforcement learning process, which updates the relationship defining data set DR through execution of the learning program 74*d*. Further, in the subsequent step S240, the CPU 72 executes a recording process through execution of the recording process program 74*e*. Then, after clearing a flag FL in the subsequent step S250, the CPU 72 temporarily suspends the processes shown in FIG. 2. The flag FL indicates whether a switching situation process, which will be discussed below, has been completed at switching from the second operation process to the first operation process.

When the traveling mode of the vehicle VC1 is the automatic acceleration travel (S210: YES), the CPU 72 determines whether the flag FL is set in step S260. If the flag FL is set (S260: YES), the CPU 72 advances the process to step S270. In step S270, the CPU 72 executes the first operation process, which operates the operated units of the internal combustion engine 10 through execution of the first operation program 74*b*. The CPU 72 then temporarily suspends the processes shown in FIG. 2. If the flag FL has been cleared (S260: NO), the CPU 72 advances the process to step S280. In step S280, the CPU 72 executes the switching situation process, which will be discussed below. In this case, the CPU 72 sets the flag FL in the subsequent step S290, and temporarily suspends the processes shown in FIG. 2.

In the series of processes shown in FIG. 2, during the manual acceleration travel, the operated units of the internal combustion engine 10 are operated using the second operation process, the relationship defining data set DR is updated using the reinforcement learning process, and the time-series data set DTS is recorded using the recording process. At this time, the flag FL remains cleared. When the traveling mode of the vehicle VC1 is switched from the manual acceleration travel to the automatic acceleration travel, the switching situation process is executed and the flag FL is set in the first control cycle after the switching. Thereafter, as long as the automatic acceleration travel continues, the operated units of the internal combustion engine 10 are operated using the first operation process. During this period, the flag FL remains set. Thus, the switching situation process is a process that is executed when the manual acceleration travel is switched to the automatic acceleration travel.

The operations of the operated units of the internal combustion engine 10 using the first operation process will now be described. In the first operation process, the operated units of the internal combustion engine 10 are operated on the basis of operated amounts that are calculated using the adapted data sets DS, which are stored in the read-only memory 74 in advance. The operations using the first operation process of some of the operated units of the internal combustion engine 10, namely, the throttle valve 14, the fuel injection valve 16, and the ignition device 26 will be described.

Figure 3:
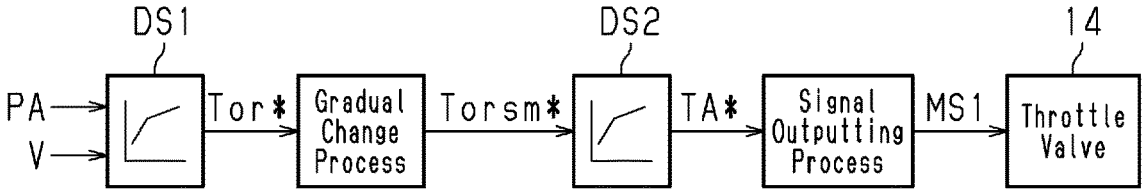
FIG. 3 is a block diagram showing flows of processes related to operation of a throttle valve in a first operation process executed by the execution device.

FIG. 3 shows a procedure of processes of the CPU 72 related to the operation of the throttle valve 14 using the first operation process. In the operation of the throttle valve 14 using the first operation process, the output of the mapping data set DS1, which uses the accelerator operated amount PA and the vehicle speed V as inputs, is calculated as the value of the requested torque Tor* as shown in FIG. 3. In the present embodiment, the first operation process is executed in the automatic acceleration traveling mode. Thus, the actual operated amount of the accelerator pedal by the driver is not used as the accelerator operated amount PA. Instead, a virtual accelerator operated amount PA is used that is obtained by converting a required amount of acceleration/deceleration of the vehicle VC1 necessary to maintain the vehicle speed V at a target speed into an operated amount of the accelerator pedal.

Subsequently, a value obtained by subjecting the requested torque Tor* to the gradual change process is calculated as a requested torque gradual change value Torsm*. The gradual change process is a filtering process that uses the requested torque Tor* as an input, and outputs a value that follows the requested torque Tor* with a delay as the requested torque gradual change value Torsm*. The present embodiment employs, as the gradual change process, a filtering process that outputs a modified moving average of the requested torque Tor* as the requested torque gradual change value Torsm*. Specifically, the calculation is executed by updating the value of the requested torque gradual change value Torsm* such that the relationship represented by the expression (1) is satisfied. In the expression (1), n is a constant that is set to an integer greater than 1. When the throttle opening degree TA changes abruptly, the gradual change process suppresses impairment of the driver comfort due to an abrupt change in the engine rotation speed NE or deterioration of the exhaust characteristics due to a response delay of the air intake.

$$Torsm*(\text{updated}) = \frac{(n-1)\times Torsm*(\text{before updated}) + Tor*}{n} \quad (1)$$

An output of the mapping data set DS2, which uses the requested torque gradual change value Torsm* as an input, is calculated as the value of an opening degree command value TA*, which is a command value of the throttle opening degree TA. A signal outputting process outputs a command signal MS1 to the throttle valve 14. The command signal MS1 instructs a change of the throttle opening degree TA to the opening degree command value TA*.

Figure 4:
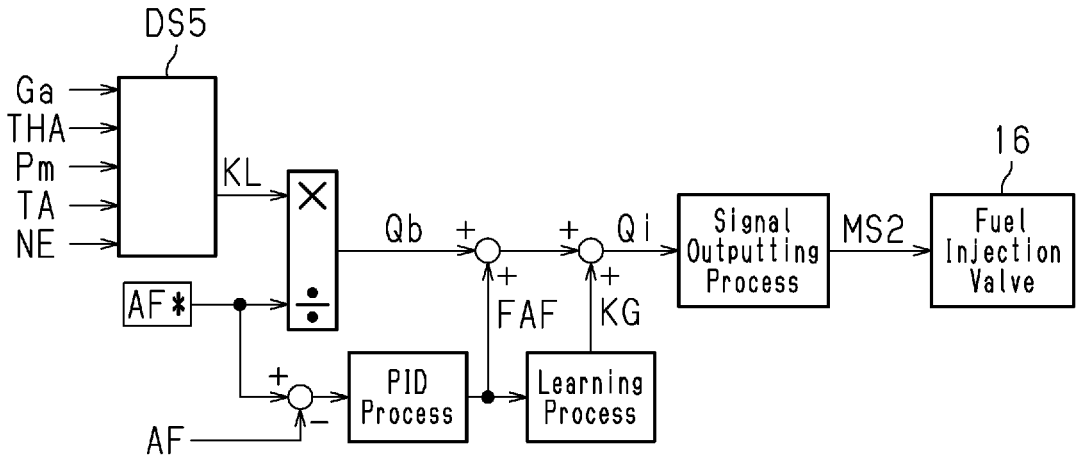
FIG. 4 is a block diagram showing flows of processes related to operation of a fuel injection valve using the first operation process executed by the execution device.

FIG. 4 shows a procedure of processes of the CPU 72 related to the operation of the fuel injection valve 16 using the first operation process. When the fuel injection valve 16 is operated using the first operation process, the model data set DS5 uses, as inputs, parameters such as the intake air amount Ga, the intake air temperature THA, the intake pressure Pm, the throttle opening degree TA, and the engine rotation speed NE as shown in FIG. 4. The output of the model data set DS5 is calculated as the value of the intake air amount KL. The intake air amount KL is divided by a target air-fuel ratio AF*, which is a target value of the air-fuel ratio of the air-fuel mixture burned in the combustion chamber 24, and the quotient is calculated as the value of a basic injection amount Qb.

An air-fuel ratio feedback correction value FAF is calculated in accordance with the deviation of the air-fuel ratio AF from the target air-fuel ratio AF*. The calculation of the air-fuel ratio feedback correction value FAF is executed by a PID process. That is, a proportional term, an integral term, and a derivative term are respectively calculated. The proportional term is a product obtained by multiplying the deviation of the detected value of the air-fuel ratio AF from the target air-fuel ratio AF* by a predetermined proportional gain. The integral term is a product obtained by multiplying the time integral of the deviation by a predetermined integral gain. The derivative term is a product obtained by multiplying the time derivative of the deviation by a predetermined derivative gain. The sum of the proportional term, the integral term, and the derivative term is calculated as the value of the air-fuel ratio feedback correction value FAF.

When the fuel injection valve 16 is operated using the first operation process, a learning process of an air-fuel ratio learning value KG is executed. The learning process of the air-fuel ratio learning value KG is executed by updating the value of the air-fuel ratio learning value KG in the manner described in the items (1) to (3) below, on the basis of the value of the air-fuel ratio feedback correction value FAF in a steady operation of the internal combustion engine 10, in which the engine rotation speed NE and the intake air amount KL are stable. (1) When the absolute value of the air-fuel ratio feedback correction value FAF is less than a predetermined update determination value, the value of the air-fuel ratio learning value KG is maintained. (2) When the air-fuel ratio feedback correction value FAF is a positive value and the absolute value is greater than or equal to the predetermined update determination value, the value of the air-fuel ratio learning value KG is updated to a difference obtained by subtracting a predetermined update amount from the air-fuel ratio learning value KG before the update. (3) When the air-fuel ratio feedback correction value FAF is a negative value and the absolute value is greater than or equal to the predetermined update determination value, the value of the air-fuel ratio learning value KG is updated to a sum obtained by adding the predetermined update amount to the air-fuel ratio learning value KG before the update.

The sum of the basic injection amount Qb, the air-fuel ratio feedback correction value FAF, and the air-fuel ratio learning value KG is calculated as the value of an injection amount command value Qi. A signal outputting process outputs a command signal MS2 to the fuel injection valve 16. The command signal MS2 instructs fuel injection of an amount corresponding to the calculated value of the injection amount command value Qi.

Figure 5:
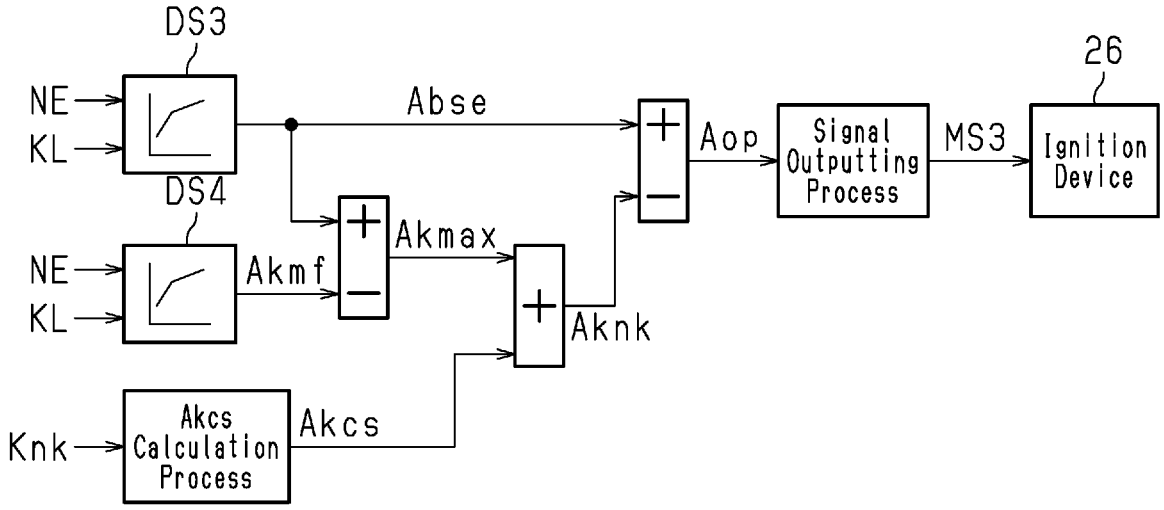
FIG. 5 is a block diagram showing flows of processes related to operation of an ignition device using the first operation process executed by the execution device.

FIG. 5 shows a procedure of processes of the CPU 72 related to the operation of the ignition device 26 using the first operation process. When the ignition device 26 is operated using the first operation process, an output of the mapping data set DS3, which uses the engine rotation speed NE and the intake air amount KL as inputs, is calculated as the basic ignition timing Abse. An output of the mapping data set DS4, which uses the engine rotation speed NE and the intake air amount KL as inputs, is calculated as a value of the retardation limit ignition timing Akmf. Then, a difference obtained by subtracting the retardation limit ignition timing Akmf from the basic ignition timing Abse is calculated as a value of a maximum retardation amount Akmax.

When the ignition device 26 is operated using the first operation process, a calculation process of a knock control amount Akcs based on the knock signal Knk is executed. The calculation of the knock control amount Akcs is executed by updating the value of the knock control amount Akcs in the manners described in the following items (4) and (5). (4) When the knock signal Knk has a value that indicates the occurrence of knocking, the knock control amount Akcs is updated to a sum obtained by adding a predetermined knock retardation amount to the value prior to the update. (5) When the knock signal Knk has a value that indicates that knocking is not occurring, the knock control amount Akcs is updated to a difference obtained by subtracting a predetermined knock advancement amount from the value prior to the update. The knock retardation amount is set to a positive value, and the knock advancement amount is set to a value larger than the knock retardation amount.

Then, a sum obtained by adding the knock control amount Akcs to the maximum retardation amount Akmax is calculated as a value of an ignition timing retardation amount Aknk, and a difference obtained by subtracting the ignition timing retardation amount Aknk from the basic ignition timing Abse is calculated as a value of an ignition timing command value Aop. A signal outputting process outputs a command signal MS3 to the ignition device 26. The command signal MS3 instructs execution of ignition at timing that corresponds to the calculated value of the ignition timing command value Aop.

The operations of the operated units of the internal combustion engine 10 using the second operation process will now be described. In the second operation process, the operated units of the internal combustion engine 10 are operated in accordance with operated amounts that are determined by the relationship defining data set DR stored in the nonvolatile memory 76 and the state of the vehicle VC1. As described above, the CPU 72 executes the reinforcement learning process in parallel with the second operation process. The reinforcement learning process is implemented by the CPU 72 executing the learning program 74*d* stored in the read-only memory 74.

In the present embodiment, the relationship defining data set DR is used to define an action value function Q and a policy π. The action value function Q is a table-type function representing values of an expected return in accordance with respective independent variables of a state s and an action a. In the present embodiment, the state s is determined on the basis of eight variables: the engine rotation speed NE, the intake air amount KL, the intake air amount Ga, the intake air temperature THA, the intake pressure Pm, the air-fuel ratio AF, the accelerator operated amount PA, and the vehicle speed V. Also, in the present embodiment, the action a is determined on the basis of three variables that are operated amounts of operated units of the internal combustion engine 10: the opening degree command value TA*, the injection amount command value Qi, and the ignition timing command value Aop. That is, the state s is an eight-dimensional vector, and the action a is a three-dimensional vector. The action value function Q(s, a) of the present embodiment is a table-type function.

Figure 6:
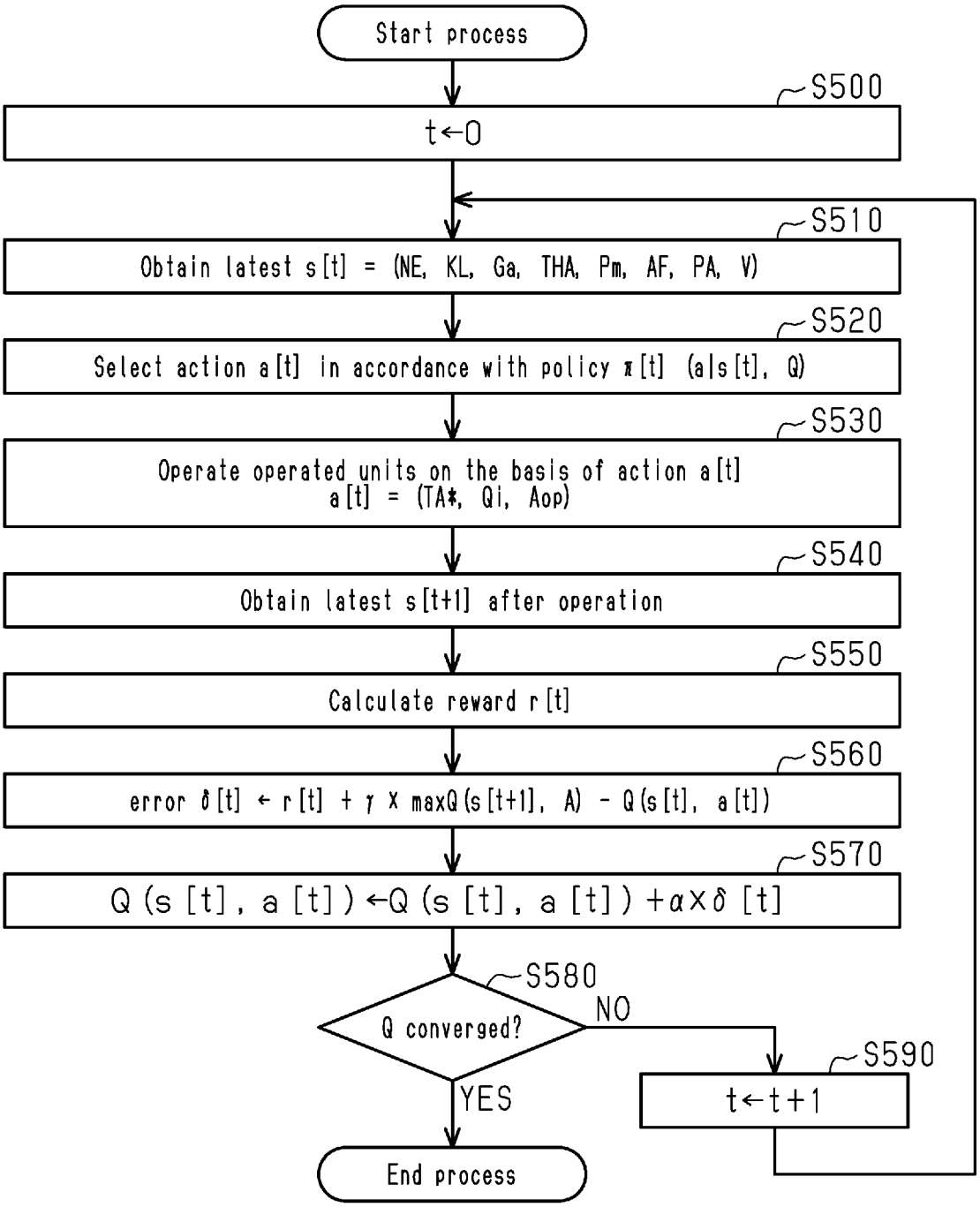
FIG. 6 is a flowchart showing a procedure of processes of a second operation process and a reinforcement learning process executed by the execution device.

FIG. 6 shows a procedure of processes of the CPU 72 related to the second operation process and the reinforcement learning process. The CPU 72 executes the series of processes shown in FIG. 6 at each execution of the second operation process in step S220 in FIG. 2. In the present embodiment, steps S510 to S530 in FIG. 6 correspond to the second operation process. Steps S540 and S590 in FIG. 6 correspond to the reinforcement learning process.

When the series of processes of FIG. 6 is started, the value oft is reset to 0 in S500. Subsequently, in step S510, the latest states of the vehicle VC1 is acquired, and the values of the variables of the acquired state s are assigned to the variables of a state s[t]. Next, in step S520, an action a[t] is selected in accordance with a policy π[t], which is defined by the relationship defining data set DR. The action a[t] refers to an action a that is selected for the state s[t]. In the state s[t], the policy π[t] maximizes the probability of selecting an action a that maximizes the action value function Q(s[t], a), that is, a greedy action, without causing the selection probability of other actions a to become 0. Since there are cases where a greedy action is not selected, a search for an optimum action is possible. The policy π is implemented by an c greedy action selection method and/or a Softmax action selection method. In the subsequent step S530, the operation signals MS1 to MS3 are respectively output to the throttle valve 14, the fuel injection valve 16, and the ignition device 26 in accordance with the opening degree command value TA*, the injection amount command value Qi, and the ignition timing command value Aop, which have been selected as the action a[t].

Thereafter, the reward r[t] is calculated in steps S540 and S550. At calculation of the reward r[t], the latest state s after operations of the operated units corresponding to the action a[t] is performed is acquired. The values of variables of the acquired state s are assigned to the values of the variables of a state s[t+1] in step S540. In step S550, a reward r[t] by the action a[t] is calculated on the basis of the state s[t+1]. The reward r[t] is calculated as a sum of multiple rewards of different factors including: a reward related to the exhaust characteristics of the internal combustion engine 10 that is obtained, for example, from an integrated value of the deviation of the air-fuel ratio AF from the target air-fuel ratio AF*; a reward related to the fuel consumption rate of the internal combustion engine 10 that is obtained, for example, from an integrated value of the injection amount command value Qi; and a reward related to the driver comfort that is obtained, for example, from an integrated value of the acceleration Gx.

Subsequently, in step S560, an error [t] is calculated. The error δ[t] is used to calculate an update amount that updates the value of the action value function Q(s[t], a[t]) in a case of the state s[t] and the action an among the values of the action value function Q. In the present embodiment, the error [t] is calculated using an off-policy temporal difference (TD) method. That is, the maximum value of the action value function Q(s[t+1], A) is multiplied by a discount factor γ. The sum of the product and the reward r[t] is obtained. The action value function Q(s[t], a[t]) is subtracted from the sum, and the resultant is used as the error δ[t]. The symbol A represents a set of the actions a. Next, in step S570, the error δ[t] is multiplied by a learning rate a, and the product is added to the action value function Q(s[t], a[t]) in order to update the action value function Q(s[t], a[t]). That is, the values of the action value function Q(s, a), which is defined by the relationship defining data set DR, include a value in which the independent variables are the state s[t] and the action a[t], and that value is changed by α·δ[t]. Through the processes of steps S560 and S570, the relationship defining data set DR is updated so as to increase the expected return of the reward r[t]. This is because the action value function Q(s[t], a[t]) is updated to become a value that highly accurately represents the actual expected return.

In the subsequent step S580, it is determined whether the value of the action value function Q of each independent variable has converged. If it is determined that convergence has not occurred (NO), the value of t is increased by 1 in step S590, and the process returns to step S510. If it is determined that the value of the action value function Q has converged (S580: YES), the series of processes shown in FIG. 6 is temporarily suspended.

Next, with reference to FIG. 7, the recording process will be described. The recording process is executed by the CPU 72 in step S240 in the series of processes shown in FIG. 2. The recording process obtains the value of the state variable used in the calculation of the operated amount using the first operation process during the operation of the operated unit using the second operation process. The recording process also records the time-series data of the obtained value of the state variable in the nonvolatile memory 76, which is a memory device.

Figure 7:
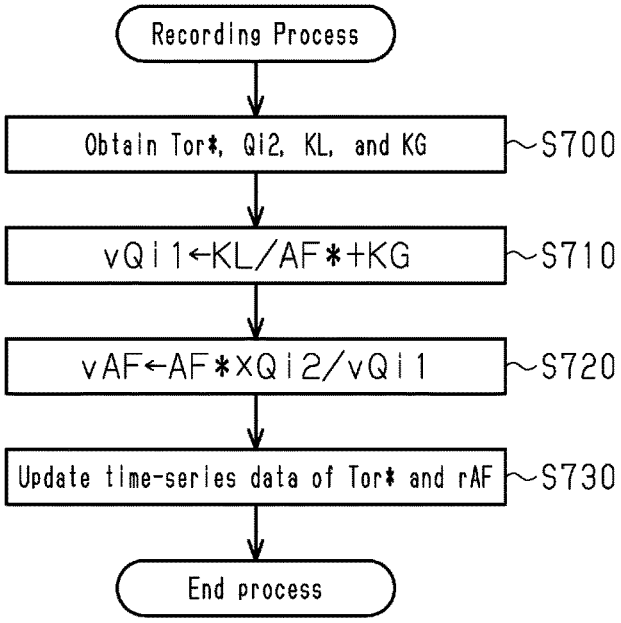
FIG. 7 is a flowchart showing a recording process executed by the execution device.

In the series of processes shown in FIG. 7, the CPU 72 first obtains, in step S700, the requested torque Tor*, the calculated value of the injection amount command value Qi by the second operation process, the intake air amount KL, and the air-fuel ratio learning value KG, which is calculated when the fuel injection valve 16 is operated using the first operation process. In the following description, the calculated value of the injection amount command value Qi obtained using the second operation process will be referred to as Qi2.

Subsequently, in step S710, the CPU 72 divides the intake air amount KL by the target air-fuel ratio AF*, adds the quotient to the air-fuel ratio learning value KG, and calculates the sum as the value of a virtual injection amount vQi1. As described above, the first operation process includes calculation of the value of the injection amount command value Qi by obtaining the sum of the basic injection amount Qb, the air-fuel ratio feedback correction value FAF, and the air-fuel ratio learning value KG. The value of the virtual injection amount vQi1 indicates the difference obtained by subtracting the air-fuel ratio feedback correction value FAF from the calculated value of the injection amount command value Qi in the first operation process, that is, the calculated value of the injection amount command value Qi in the first operation process when the air-fuel ratio feedback correction value FAF is set to 0.

In the subsequent step S720, the CPU 72 divides Qi2 by vQi1, multiplies the quotient by the target air-fuel ratio AF*, and calculates the product as the value of a virtual air-fuel ratio vAF. As described above, the second operation process performs adaptation of the operated amounts through the reinforcement learning. The reward r of the reinforcement learning includes a reward related to the exhaust characteristics of the internal combustion engine 10 that has been obtained from a parameter such as an integrated value of the deviation of the air-fuel ratio AF from the target air-fuel ratio AF*. If the adaptation of the operated amounts through the reinforcement learning has progressed sufficiently, Qi2, which is a calculated value of the injection amount command value Qi by the second operation process, is expected to have become a value that causes the air-fuel ratio AF to become the target air-fuel ratio AF*. The air-fuel ratio AF is a quotient obtained by dividing the mass of air by the mass of fuel in the air-fuel mixture burned in the combustion chamber 24. Therefore, if Qi2 is the injection amount command value Qi that causes the air-fuel ratio AF to become the target air-fuel ratio AF*, the air-fuel ratio AF when the fuel injection valve 16 is operated using a predetermined value Qx as the value of the injection amount command value Qi, is equal to a product obtained by multiplying, by the target air-fuel ratio AF*, a quotient obtained by dividing Qi2 by Qx (AF=AF*×Qi2/Qx). Therefore, in the current situation, in which the fuel injection valve 16 is operated using the second operation process, the virtual air-fuel ratio vAF represents an expected value of the air-fuel ratio AF in a case in which it is assumed that the fuel injection valve 16 is operated while setting the injection amount command value Qi to the virtual injection amount vQi1.

Next, in step S730, the CPU 72 updates the requested torque Tor* recorded in the nonvolatile memory 76 and the time-series data set DTS of the virtual air-fuel ratio vAF, and ends the series of processes shown in FIG. 7. In the present embodiment, data including n values of the requested torque Tor* is recorded as the time-series data of the requested torque Tor*. The sign n represents the number of times the value of the requested torque Tor* has been obtained in consecutive control cycles from the control cycle of n times previous until the current control cycle. In the present embodiment, data including m values of the virtual air-fuel ratio vAF is recorded as the time-series data of the virtual air-fuel ratio vAF. The sign m represents the number of times the value of the virtual air-fuel ratio vAF has been obtained in consecutive control cycles from the control cycle of m times previous until the current control cycle. The sign m is an integer greater than 1.

The switching situation process will now be described with reference to FIG. 8. As described above, the switching situation process is executed when the manual acceleration travel is switched to the automatic acceleration travel.

Figure 8:
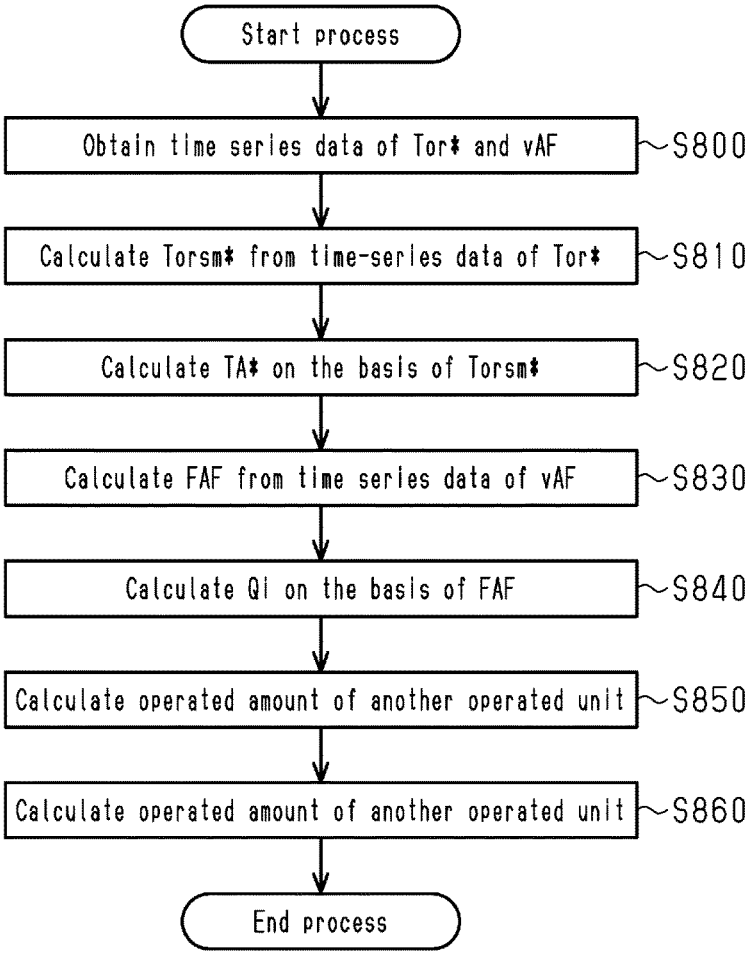
FIG. 8 is a flowchart showing a switching situation process executed by the execution device.

When the series of processes shown in FIG. 8 is started, the CPU 72 first obtains, in step S800, the time-series data of the requested torque Tor* and the virtual air-fuel ratio vAF recorded in the nonvolatile memory 76. In the subsequent step S810, the CPU 72 calculates the requested torque gradual change value Torsm* on the basis of the obtained time-series data of the requested torque Tor*. In the present embodiment, the CPU 72 calculates, as the requested torque gradual change value Torsm*, the average of the n values of the requested torque Tor* included in the time-series data of the requested torque Tor*. Further, in step S820, the CPU 72 calculates the opening degree command value TA* on the basis of the calculated requested torque gradual change value Torsm*. Specifically, the CPU 72 calculates, as the opening degree command value TA*, the output value of the mapping data set DS2, which uses the requested torque gradual change value Torsm* as an input value.

In the subsequent step S830, the CPU 72 calculates the air-fuel ratio feedback correction value FAF from the time-series data of the virtual air-fuel ratio vAF. In the present embodiment, the air-fuel ratio feedback correction value FAF is calculated in the manner described below. At the calculation of the air-fuel ratio feedback correction value FAF, the moving average of the values of the virtual air-fuel ratio vAF in the time-series data is obtained first. Subsequently, the current intake air amount KL is divided by the moving average, and the quotient is calculated as a value Qf, which is a value of the injection amount command value Qi required to cause the air-fuel ratio AF to become the target air-fuel ratio AF*. Also, the current intake air amount KL is divided by the target air-fuel ratio AF*, and the quotient is calculated as the value of the basic injection amount Qb. Then, the sum of the basic injection amount Qb and the air-fuel ratio learning value KG is subtracted from the value Qf, and the difference is calculated as the value of the air-fuel ratio feedback correction value FAF. That is, in the present embodiment, the air-fuel ratio feedback correction value FAF is calculated assuming that the value Qf, which is obtained from the time-series data of the virtual air-fuel ratio vAF, is a value of the injection amount command value Qi that causes the air-fuel ratio AF to become the target air-fuel ratio AF*. In the subsequent step S840, the CPU 72 calculates, as the value of the injection amount command value Qi, the sum of the basic injection amount Qb, the air-fuel ratio feedback correction value FAF, and the air-fuel ratio learning value KG.

Next, the CPU 72 calculates operated amounts of other operated units of the internal combustion engine 10 that include the ignition timing command value Aop in step S850. The calculation of the operated amounts is executed in the same manner as the first operation process. In the subsequent step S860, the CPU 72 operates the operated units of the internal combustion engine 10 on the basis of the calculated values of the operated amounts in the first calculation process. The CPU 72 then temporarily suspends the processes shown in FIG. 8.

In the above-described switching situation process, operations of the operated units of the internal combustion engine 10 are performed in the same manner as the first operation process except for the following two points. Specifically, the two differences of the switching situation process from the first operation process are that the requested torque gradual change value Torsm*, which is used to calculate the opening degree command value TA*, is calculated on the basis of the time-series data of the requested torque Tor*, and that the air-fuel ratio feedback correction value FAF, which is used to calculate the injection amount command value Qi, is calculated on the basis of the time-series data of the virtual air-fuel ratio vAF.

An operation and advantages of the present embodiment will now be described.

The controller 70 of the present embodiment operates the operated units of the internal combustion engine 10 by selecting one of the first operation process or the second operation process. In the first operation process, the operated units are operated using the operated amounts that are calculated using the adapted data sets DS, which are stored in the read-only memory 74 in advance. The adapted data sets DS, which are used in calculation of the operated amounts using the first operation process, must be adapted before shipping of the vehicle VC1. In the second operation process, the operated units are operated using operated amounts that are determined by the relationship defining data set DR stored in the nonvolatile memory 76 and the state of the vehicle VC1. During execution of the second operation process, the reward r is calculated on the basis of the state of the vehicle VC1, which changes as the result of operations of the operated units using the second operation process. Also, the relationship defining data set DR is updated such that the expected return of the reward r is increased. That is, during the operations of the operated units of the internal combustion engine 10 using the second operation process, adaptation of the operated amounts is advanced through the reinforcement learning. In this manner, the operated amounts are adapted through the reinforcement learning during traveling of the vehicle VC1. This reduces the man-hours of skilled workers required to adapt the operated amounts. However, adaptation of operated amounts through reinforcement learning during traveling of a vehicle increases the computation load on the controller 70. Thus, although adaptation of the operated amounts through reinforcement learning during traveling of a vehicle is advantageous in reduction of the man-hours by skilled workers required to adapt operation amounts, it is disadvantageous because it increases the calculation load on the controller 70. Also, it takes a certain amount of time for the operated amounts to be adapted through the reinforcement learning. This may reduce the controllability of the internal combustion engine 10 until the adaptation is completed.

The controller 70 of the present embodiment is used for the internal combustion engine 10 mounted on the vehicle VC1, which performs the manual acceleration travel and the automatic acceleration travel. In the manual acceleration travel, the vehicle VC1 is accelerated or decelerated in response to an operation of the accelerator pedal 87 by the driver. In the automatic acceleration travel, the vehicle VC1 is automatically accelerated or decelerated regardless of an operation of the accelerator pedal 87. The state of the vehicle VC1 varies between the manual acceleration travel and the automatic acceleration travel. Thus, the adaptation of the operated amounts must be performed separately. The automatic acceleration travel of the vehicle VC1 is performed only when the driver selects the automatic acceleration travel while traveling on a limited-access road. Accordingly, the automatic acceleration travel may be performed less frequently than the manual acceleration travel. Thus, if the adaptation of the operated amounts during the automatic acceleration travel is performed through the reinforcement learning, a state in which the adaptation is incomplete may have a long duration.

In the present embodiment, for the manual acceleration travel, which is expected to be performed relatively frequently, the operated amounts are adapted through the reinforcement learning during traveling of the vehicle VC1. On the other hand, for the automatic acceleration travel, which is expected to be performed less frequently, the operated amounts are adapted by a conventional method. In the present embodiment, although the operated amounts need to be adapted by a conventional method for the automatic acceleration travel, the number of man-hours of skilled workers required to perform the adaptation is reduced as compared to a case in which the adaptation of the operated amounts is performed by a conventional method for both of the manual acceleration travel and the automatic acceleration travel.

When the opening degree command value TA* of the throttle valve 14 is calculated using the first operation process as described above, the gradual change process is executed that uses the requested torque Tor* as an input, and outputs a value that follows the requested torque Tor* with a delay as the requested torque gradual change value Torsm*. An output of the mapping data set DS2, which uses the requested torque gradual change value Torsm* as an input, is calculated as the value of the opening degree command value TA*. In the following description, the calculated value of the opening degree command value TA* by the first operation process will be represented by TA*[1]. Also, the calculated value of the opening degree command value TA* by the second operation process will be represented by TA*[2].

In FIG. 9A, the long-dash double-short-dash line represents an abrupt drop of the requested torque Tor*, and the solid line represents a corresponding change in the requested torque gradual change value Torsm*. In FIG. 9B, the solid line represents a corresponding change in the calculated value TA*[1]. The calculated value TA*[1] is calculated as a value that changes after a delay from a change in the requested torque Tor*. In the first operation process, the gradual change process limits deterioration of the exhaust characteristics of the internal combustion engine 10 due to a response delay of the intake air and a reduction in the driver comfort due to an abrupt change in the engine rotation speed NE.

In contrast, the second operation process uses the state s of the vehicle VC1 as an input to the relationship defining data set DR, and calculates the operated amounts of the operated units of the internal combustion engine 10 as outputs of the relationship defining data set DR. The adaptation of the operated amounts using the second operation process is performed through the reinforcement learning based on the reward r, which is calculated from a view point of the exhaust characteristics of the internal combustion engine 10 and/or the driver comfort. If the adaptation through the reinforcement learning is performed properly, the calculated value TA* [2] of the opening degree command value TA* by the second operation process is calculated as a value that changes after a delay from a change in the requested torque Tor*, like the calculated value TA*[1] by the first operation process. In the following description, a transient period refers to a period during which the opening degree command value TA* is changing from a point in time at which the opening degree command value TA* starts changing in response to a change in the requested torque Tor* to a point in time at which the opening degree command value TA* converges to a value corresponding to the changed requested torque Tor*.

An exemplary case assumes that the operations of the operated units are switched from the second operation process to the first operation process at a point in time t1 during the transient period in FIGS. 9A and 9B, and the calculation of the opening degree command value TA* using the first operation process is started at the same time as the switching of the operation processes. In FIGS. 9A and 9B, changes in the requested torque gradual change value Torsm* and the opening degree command value TA* in this case are indicated by respective dotted lines. In this case, the calculated value TA*[2] of the second operation process is used to operate the throttle valve 14 before the point in time t1, and the calculated value TA*[1] of the first operation process is used to operate the throttle valve 14 after the point in time t1. In this case, since the gradual change process is also started at the point in time t1, changes in the requested torque Tor* before the point in time t1 are not reflected on the calculated value TA*[1]. Thus, the opening degree command value TA* changes in a stepwise manner at the switching from the second operation process to the first operation process, which causes the controllability of the internal combustion engine 10 to deteriorate.

In this regard, the CPU 72 of the present embodiment obtains, in the recording process, the value of the requested torque Tor* during the operation of the operated unit of the internal combustion engine 10 using the second operation process, and records the time-series data of the obtained value of the requested torque Tor* in the nonvolatile memory 76. In the switching situation process, which is executed when the second operation process is switched to the first operation process, the CPU 72 calculates the requested torque gradual change value Torsm* from the recorded time-series data of the requested torque Tor*. The requested torque gradual change value Torsm* follows, with a delay, the requested torque Tor* during operation using the second operation process prior to switching to the first operation process. In the switching situation process, the CPU 72 calculates the opening degree command value TA* on the basis of the requested torque gradual change value Torsm*, which is calculated from the time-series data of the requested torque Tor*, in the switching situation process. Thus, the opening degree command value TA* is unlikely to change in a stepwise manner when the second operation process is changed to the first operation process.

Further, the first operation process corrects the injection amount command value Qi using the air-fuel ratio feedback correction value FAF. That is, the first operation process performs the air-fuel ratio feedback correction. The air-fuel ratio feedback correction compensates for the deviation of the air-fuel ratio AF from the target air-fuel ratio AF* due to such individual differences and changes over time of the injection characteristics of the fuel injection valve 16 and the intake characteristics of the internal combustion engine 10. It takes a certain amount of time for the air-fuel ratio feedback correction to cause the air-fuel ratio AF to converge to the target air-fuel ratio AF*. Thus, if the second operation process is switched to the first operation process, and the air-fuel ratio feedback correction is started from a state in which the air-fuel ratio feedback correction value FAF is 0, the air-fuel ratio AF temporarily deviates from the target air-fuel ratio AF*. This may cause the exhaust characteristics of the internal combustion engine 10 to deteriorate.

In this regard, in the present embodiment, during the operation of the operated unit of the internal combustion engine 10 using the second operation process, the CPU 72 obtains, in the recording process, the virtual air-fuel ratio vAF, which is a virtual value of the air-fuel ratio AF used in the calculation of the air-fuel ratio feedback correction value FAF using the first operation process. The CPU 72 also records the time-series data in the nonvolatile memory 76. The air-fuel ratio feedback correction value FAF, which causes the air-fuel ratio AF to become the target air-fuel ratio AF*, is obtained from the value of the virtual air-fuel ratio vAF, of which the time-series data is recorded. During the switching situation process, which is executed when the second operation process is switched to the first operation process, the CPU 72 calculates the air-fuel ratio feedback correction value FAF from the recorded time-series data of the virtual air-fuel ratio vAF, and calculates the injection amount command value Qi in accordance with the air-fuel ratio feedback correction value FAF, in order to operate the fuel injection valve 16. Thus, the air-fuel ratio feedback correction value FAF is set to a value that causes the air-fuel ratio AF to become the target air-fuel ratio AF* from the start of the operation using the first operation process. This prevents the air-fuel ratio AF from being significantly different from the target air-fuel ratio AF* immediately after the start of the operation of the fuel injection valve 16 using the first operation process.

The present embodiment has the following advantages.

(1) In the above-described embodiment, adaptation of the operated amounts of the operated units of the internal combustion engine 10 for the manual acceleration travel, which is expected to be performed relatively frequently, is performed through reinforcement learning during traveling of the vehicle VC1. On the other hand, the automatic acceleration travel is expected to be performed less frequently, and the opportunities of the performance of reinforcement learning is thought to be limited during the automatic acceleration travel of the vehicle VC1. Accordingly, adaptation of the operated amounts of the operated units for the automatic acceleration travel is performed by a conventional method. Therefore, the adaptation of the operated amounts for each of the manual acceleration travel and the automatic acceleration travel is performed by a suitable method. Also, the number of man-hours of skilled workers is reduced.

(2) The adaptation of the operated amounts in the manual acceleration travel is performed through the reinforcement learning during traveling of the vehicle VC1. Thus, individual differences and/or changes over time of the internal combustion engine 10 are reflected on the results of the adaptation of the operated amounts of the operated units of the internal combustion engine 10 during the manual acceleration travel. This limits deterioration of the controllability of the internal combustion engine 10 due to such individual differences and/or changes over time.

(3) In the recording process, the CPU 72 of the above-described embodiment obtains the value of the requested torque Tor*, which is used in the calculation of the opening degree command value TA* using the first operation process, during operation of the operated unit of the internal combustion engine 10 using the second operation process. The CPU 72 records the time-series data of the obtained value of the requested torque Tor* in the nonvolatile memory 76. Using the time-series data of the recorded requested torque Tor*, the opening degree command value TA* at the time of ending the second operation process and starting the first operation process is calculated as a value that reflects a change in the requested torque Tor* prior to the start of the first operation process. Thus, the value of the opening degree command value TA* is unlikely to change in a stepwise manner when the second operation process is changed to the first operation process.

(4) During the operation of the operated unit of the internal combustion engine 10 using the second operation process, the CPU 72 of the above-described embodiment obtains, in the recording process, the virtual air-fuel ratio vAF, which is a virtual value of the air-fuel ratio AF used in the calculation of the air-fuel ratio feedback correction value FAF using the first operation process, and records the time-series data of the obtained virtual air-fuel ratio vAF in the nonvolatile memory 76. Using the time-series data of the recorded virtual air-fuel ratio vAF, the air-fuel ratio feedback correction value FAF is obtained that causes the air-fuel ratio AF at the time of ending the second operation process and starting the first operation process to become the target air-fuel ratio AF*. Thus, the air-fuel ratio AF is unlikely to deviate from the target air-fuel ratio AF* immediately after the second operation process is switched to the first operation process.

The present embodiment may be modified as follows. The present embodiment and the following modifications can be combined as long as the combined modifications remain technically consistent with each other.

Regarding Automatic Acceleration Travel and Manual Acceleration Travel

In the above-described embodiment, the automatic acceleration travel is a traveling mode that automatically accelerates or decelerates the vehicle VC1 so as to maintain the vehicle speed V at the target speed. The present disclosure is not limited to this. The automatic acceleration travel may be a traveling mode that automatically accelerates or decelerates the vehicle VC1 on the basis of detection results of the road on which the vehicle VC1 is traveling, and vehicles and/or pedestrians around the vehicle VC1 Also, in the automatic acceleration travel, at least one of steering and braking of the vehicle VC1 may be performed automatically in addition to acceleration and deceleration of the vehicle VC1. Further, in the manual acceleration travel, at least one of steering and braking of the vehicle VC1 may be performed automatically, while acceleration or deceleration of the vehicle VC1 is performed in response to the operation of the accelerator pedal by the driver.

Regarding Operated Units of Internal Combustion Engine

The operated units of the internal combustion engine 10 subject to switching between the first operation process and the second operation process may include operated units other than the throttle valve 14, the fuel injection valve 16, and the ignition device 26. For example, the present disclosure may be employed in an internal combustion engine that is provided with an exhaust gas recirculation mechanism, which recirculates some of exhaust gas to intake air, and an EGR valve, which is located in the exhaust gas recirculation mechanism and regulates the recirculated amount of exhaust gas. In this case, the EGR valve may be an operated unit of the internal combustion engine subject to switching between the first operation process and the second operation process. Also, the present disclosure may be employed in an internal combustion engine that is provided with a variable valve actuation mechanism, which varies actuation of the intake valve 18 and/or the exhaust valve 30. In this case, the variable valve actuation mechanism may be an operated unit of the internal combustion engine subject to switching between the first operation process and the second operation process.

Regarding Switching Process

In the above-described embodiment, the first operation process is executed during the automatic acceleration travel, and the second operation process is executed during the manual acceleration travel. In a vehicle that is operated to perform mainly the automatic acceleration travel and perform the manual acceleration travel in limited situations, the adaptation of the operated amounts through reinforcement learning during traveling of the vehicle is suitable for the automatic acceleration travel, but is not suitable for the manual acceleration travel in some cases. In such a case, the second operation process may be executed during the automatic acceleration travel, and the first operation process may be executed during the manual acceleration travel.

The operation process may be switched in accordance with states of the vehicle VC1 other than those described above. In some cases, the operational zones of the internal combustion engine 10 include a zone that is not used frequently, such as a high-load high-speed zone. In an operational zone that is not used frequently, the adaptation of the operated amounts through reinforcement learning during traveling of the vehicle VC1 is delayed as compared to other operational zones. Therefore, the internal combustion engine 10 may be configured such that the operated units are operated using the first operation process in an operational zone that is not used frequently, and that the operated units are operated using the second operation process in an operational zone that is used frequently.

Further, the operated units that are subject to the switching between the first operation process and the second operation process using the switching process may be limited to some of the operated units of the internal combustion engine, and the remaining operated units may be controlled using the first operation process or the second operation process either in the manual acceleration travel or the automatic acceleration travel.

Regarding State s

In the above-described embodiment, the state s includes eight parameters: the engine rotation speed NE, the intake air amount KL, the intake air amount Ga, intake air temperature THA, the intake pressure Pm, the air-fuel ratio AF, the accelerator operated amount PA, and the vehicle speed V. However, the present disclosure is not limited to this. One or more of the parameters may be removed from the state s. Alternatively, the state s may include additional parameters that indicate the state of the internal combustion engine 10 or the vehicle VC1.

Regarding Reward r

The calculation of the reward r based on the state s may be performed in a manner different from those in the above-described embodiment. For example, amounts of emission of hazardous constituents in the exhaust, such as nitrogen oxide and fine particulate matter may be obtained, and a reward related to the exhaust characteristics of the internal combustion engine 10 may be calculated on the basis of the amounts of emission. Alternatively, the levels of vibrations and noises in the passenger compartment may be measured, and a reward related to the comfort may be calculated on the basis of the measurement results.

Regarding Action Value Function Q

In the above-described embodiment, the action value function Q is a table-type function. However, the present disclosure is not limited to this. For example, a function approximator may be used as the action value function Q. Also, instead of using the action value function Q, the policy $\pi$ may be expressed by a function approximator that uses the state s and the action a as independent variables, and uses, as a dependent variable, the probability that the action a will be taken. The policy $\pi$ may also be updated in accordance with the reward r.

Regarding Update of Relationship Defining Data Set DR

In the above-described embodiment, the relationship defining data set DR is updated by the off-policy TD method. However, the present disclosure is not limited to this. For example, the update may be performed by an on-policy TD method such as a state-action-reward-state-action (SARSA) method. Also, an eligibility trace method may be used as an on-policy update method. Alternatively, the relationship defining data set DR can be updated by a method different from the ones described above, such as a Monte Carlo method.

Regarding Feedback Correction Process

The calculation of the injection amount command value Qi of the fuel injection valve 16 using the first operation process according to the above-described embodiment is executed through the feedback correction process in accordance with the air-fuel ratio AF. The recording process records the time-series data of the air-fuel ratio AF, which is the state variable used in the feedback correction process. More specifically, the recording process records the time-series data of the virtual air-fuel ratio vAF, which is a virtual value of the air-fuel ratio AF. When the operated amounts calculated using the first operation process include an operated amount that is calculated using the feedback correction process in addition to the injection amount command value Qi, the state variable used in the feedback correction process may be included in the state variables of which the time-series data is recorded in the recording process.

The feedback correction process refers to a process that uses one of the state variables of the vehicle VC1 as a controlled variable, calculates the feedback correction value in accordance with the deviation between the target value and the detected value of the controlled variable, and corrects the value of the operated amount calculated using the adapted data sets DS by the feedback correction value.

Regarding Gradual Change Process

The calculation of the opening degree command value TA* of the throttle valve 14 using the first operation process in the above-described embodiment is executed through the gradual change process. The recording process records the time-series data of the requested torque Tor*, which is a state variable subject to the gradual change process. When the operated amounts calculated using the first operation process include an operated amount that is calculated using the gradual change process in addition to the opening degree command value TA*, the state variable subjected to the gradual change process may be included in the state variables of which the time-series data is recorded in the recording process.

The gradual change process refers to the following process. The calculation of the operated amounts in the gradual change process is also executed using adapted data that is stored in the memory device in advance, uses a state variable indicating the state of the vehicle as an input, and defines a map that outputs the operated amounts. The gradual change process is one of two different processes A and B. The process A uses a detected value of a state variable as an input, and outputs, as an input value to the map, a value that changes after a delay in relation to the detected value. The process B uses the output value of the map as an input, and outputs, as a calculated value of the operated amount, a value that changes after a delay in relation to the output value. When the opening degree command value TA* of the throttle valve 14 is calculated in the above-described embodiment, the process A is executed as the gradual change process. However, the process B can be executed as the gradual change process.

FIG. 10 shows a procedure of processes of the CPU 72 related to the operation of the throttle valve 14 using the first operation process in a case in which the process B is executed as the gradual change process in order to calculate the opening degree command value TA*. When the throttle valve 14 is operated using the first operation process in this case, the output of the mapping data set DS1, which uses the accelerator operated amount PA and the vehicle speed V as inputs, is calculated as the value of the requested torque Tor* as shown in FIG. 10. An output of the mapping data set DS2, which uses the requested torque Tor* as an input, is calculated as the value of the opening degree command value TA*. Further, the value obtained by subjecting the opening degree command value TA* to the gradual change process is calculated as an opening degree gradual change command value TAsm*. A signal outputting process outputs a command signal MS1 to the throttle valve 14. The command signal MS1 instructs a change of the throttle opening degree TA to the opening degree gradual change command value Tasm*.

Even in this case, using the time-series data of the requested torque Tor* allows the opening degree command value TA* at the starting of the first operation process to be calculated as a value that changes after a delay from a change in the requested torque Tor*. That is, the gradual change value of the requested torque Tor* is obtained from the time-series data of the requested torque Tor* and the current value of the requested torque Tor*. An output of the mapping data set DS2, which uses the gradual change value as an input, is calculated as the opening degree command value TA*. The throttle valve 14 is operated in accordance with the calculated opening degree command value TA*.

Regarding Recording Process

In the above-described embodiment, the time-series data of two state variables, which are the requested torque Tor* and the virtual air-fuel ratio vAF, is recorded in the recording process. The requested torque Tor* and the virtual air-fuel ratio vAF are respectively used in the calculation of operated amounts, which are the opening degree command value TA* and the injection amount command value Qi in the first operation process. The time-series data of the value of a state variable used to calculate another operated amount using the first operation process may be recorded in the recording process. Alternatively, the time-series data of all the state variables used to calculate an operated amount using the first operation process may be recorded in the recording process.

The controller 70 may be processing circuitry including: 1) one or more processors that operate according to a computer program (software); 2) one or more dedicated hardware circuits (application specific integrated circuits: ASIC) that execute at least part of various processes, or 3) a combination thereof. The processor includes a CPU and memories such as a RAM and a ROM. The memories store program codes or commands configured to cause the CPU to execute processes. The memory, which is computer readable medium, includes any type of media that are accessible by general-purpose computers and dedicated computers.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for an internal combustion engine mounted on a vehicle, the controller being configured to control the internal combustion engine by operating an operated unit of the internal combustion engine, the controller comprising:

a memory device, which is configured to store, in advance a relationship defining data set that defines a relationship between a state variable that represents a state of the vehicle, which includes a state of the internal combustion engine, and an operated amount of the operated unit, the relationship defining data set being updated during traveling of the vehicle, and an adapted data set that is used to calculate the operated amount based on the state variable, the adapted data set not being updated during traveling of the vehicle; and an execution device, which is configured to execute an operation of the operated unit, wherein the execution device is configured to execute:

a first operation process that operates the operated unit by the operated amount, which is calculated on a basis of the state variable, using the adapted data set;

a second operation process that operates the operated unit by the operated amount that is defined by the relationship defining data set and the state variable;

a reinforcement learning process that calculates a reward on a basis of the state variable when the operated unit is being operated using the second operation process, and updates the relationship defining data set so as to increase an expected return of the reward on a basis of the state variable, the operated amount, and the reward;

a switching process that switches a process that operates the operated unit in accordance with the state of the vehicle between the first operation process and the second operation process; and a recording process that obtains a value of the state variable used in the calculation of the operated amount using the first operation process during the operation of the operated unit using the second operation process, and records time-series data of the obtained value of the state variable to the memory device.

2. The controller for an internal combustion engine according to claim 1, wherein the recorded state variable of which the time-series data is recorded to the memory device in the recording process is part of one or more state variables used in calculation of the operated amount using the first operation process.

3. The controller for an internal combustion engine according to claim 2, wherein the first operation process includes a feedback correction process that uses a value of the part of the one or more state variables as a controlled variable, and corrects the operated amount in accordance with a difference between a target value of the controlled variable and a detected value of the controlled variable.

4. The controller for an internal combustion engine according to claim 2, wherein the adapted data set includes a data set that defines a map, the map using a state variable included in the part of the one or more state variables as an input, and outputting the operated amount, and the first operation process includes a gradual change process, which is one of a process that uses a detected value of the state variable as an input, and outputs, as an input value to the map, a value that changes after a delay in relation to the detected value, and a process that uses an output value of the map as an input, and outputs, as a calculated value of the operated amount, a value that changes after a delay in relation to the output value.

5. The controller for an internal combustion engine according to claim 1, wherein the vehicle performs a manual acceleration travel, in which the vehicle is accelerated or decelerated in response to an operation of an accelerator pedal by a driver, and an automatic acceleration travel, in which the vehicle is automatically accelerated or decelerated regardless of the operation of the accelerator pedal, and the switching process switches the process that operates the operated unit between the first operation process and the second operation process depending on whether the vehicle is performing the manual acceleration travel or the automatic acceleration travel.

6. A method of controlling an internal combustion engine mounted on a vehicle by operating an operated unit of the internal combustion engine, the method comprising:

storing, in advance, a relationship defining data set that defines a relationship between a state variable that represents a state of the vehicle, which includes a state of the internal combustion engine, and an operated amount of the operated unit, the relationship defining data set being updated during traveling of the vehicle;

storing, in advance, an adapted data set that is used to calculate the operated amount based on the state variable, the adapted data set not being updated during traveling of the vehicle; and executing an operation of the operated unit, wherein the executing the operation of the operated unit includes executing:

a first operation process that operates the operated unit by the operated amount, which is calculated on a basis of the state variable, using the adapted data set;

a second operation process that operates the operated unit by the operated amount that is defined by the relationship defining data set and the state variable;

a reinforcement learning process that calculates a reward on a basis of the state variable when the operated unit is being operated using the second operation process, and updates the relationship defining data set so as to increase an expected return of the reward on a basis of the state variable, the operated amount, and the reward;

a switching process that switches a process that operates the operated unit in accordance with the state of the vehicle between the first operation process and the second operation process; and a recording process that obtains a value of the state variable used in calculation of the operated amount using the first operation process during an operation of the operated unit using the second operation process, and records time-series data of the obtained value of the state variable.

* * * * *